US006039199A

United States Patent [19]

Jordi

[11] Patent Number: 6,039,199

[45] Date of Patent: Mar. 21, 2000

[54] SCREW CAP

[75] Inventor: Hans Ulrich Jordi, Oberdiessbach, Switzerland

[73] Assignee: Neopac AG, Oberdiessbach, Switzerland

[21] Appl. No.: 09/216,750

[22] Filed: Dec. 17, 1998

Related U.S. Application Data

[63] Continuation of application No. PCT/IB96/00405, May 6, 1996.

[51] Int. Cl.[7] ..... B65D 39/08; B65D 41/34

[52] U.S. Cl. ..... 215/254; 215/252; 215/354

[58] Field of Search ..... 215/252, 217, 215/223, 250, 253, 256, 329, 330, 356; 220/265, 266, 270, 276

[56] References Cited

U.S. PATENT DOCUMENTS

| | | | |
|---|---|---|---|
| 3,874,540 | 4/1975 | Hidding . | |
| 3,902,621 | 9/1975 | Hidding | 215/252 |
| 4,326,639 | 4/1982 | Stahl et al. . | |
| 4,385,708 | 5/1983 | Curry | 215/256 |
| 4,415,094 | 11/1983 | Bavnsfelt . | |
| 4,759,465 | 7/1988 | Landis | 215/256 |
| 5,251,769 | 10/1993 | Battegazzore | 215/252 |
| 5,285,912 | 2/1994 | Molinaro | 215/256 |
| 5,690,243 | 11/1997 | Molinaro | 215/256 |

FOREIGN PATENT DOCUMENTS

| | | |
|---|---|---|
| 2 150 709 | 4/1973 | Germany . |
| 22 43 220 | 3/1974 | Germany . |
| 29 10 178 B1 | 6/1980 | Germany . |
| 32 02 226 A1 | 9/1982 | Germany . |
| 32 33 806 A1 | 3/1984 | Germany . |
| 2 163 413 | 2/1986 | United Kingdom . |

*Primary Examiner*—Allan N. Shoap
*Assistant Examiner*—Niki M. Eloshway
*Attorney, Agent, or Firm*—Marshall, O'Toole, Gerstein, Murray & Borun

[57] ABSTRACT

The invention provides a safety seal device which includes a tear-off strip and a band section. The band section is subdivided into circular arc sections and U-shaped sections. The band section is provided with wedge-shaped locking elements. In addition, the band section is joined to the body of the screw cap via first breakaway webs. The U-shaped sections form spring elements in the band section thereby elastically suspending the locking elements. For this reason, the locking elements can elastically give when the screw cap is first screwed on, so that the safety closure cannot be plastically deformed when the screw cap is screwed on, which would jeopardize its security.

2 Claims, 2 Drawing Sheets

SCREW CAP

This application is a continuation of International Application PCT/IB96/00405 filed May 6, 1996.

BACKGROUND OF THE INVENTION

The present invention concerns a screw cap for closure of a container, said screw cap having a screw cap body and a safety seal device with a continuous band section and a tear-off strip joined to it, said band section having internal blocking elements on its inside, each with a leading slope and a locking surface, said container having outer locking elements that mesh with the inner locking elements when the container is closed and are arranged along its outer periphery at its opening, said band section also being joined to the screw cap body via first breakaway webs.

First closure of such a container to achieve locking of the locking elements occurs by a screw motion between the screw cap and container. On achieving thread engagement the tooth-like locking elements of the screw cap and of the container begin to slide one over the other, during which the locking elements slide or snap into the locking position over their leading slopes and movement in the opening direction is prevented by mutual contact of the locking surfaces of the locking elements.

The locking elements of the screw cap are arranged on a safety seal, which is torn off the screw cap body to open the container. For this purpose the safety seal is joined to the body of the screw cap via webs, said webs being broken during tearing of the safety seal from the screw cap by the force effect of the user.

When the locking elements slide over each over for locking during the rotary movement, yielding movements of these locking elements necessarily occur. Whereas elastic deformations occur in the locking elements of the mentioned type, especially in the case of plastic, permanent plastic deformations can also occur. Contrarily, if a relatively soft, i.e., elastic material is used, there is a hazard that locking between the locking elements is not secure because the locking elements can also yield elastically during unpermitted twisting movement and thus release the screw cap.

Containers, especially compressible containers and tubes that are intended to release, for example, eyedrops or nosedrops, have an elongated spout, a nozzle. When such containers are produced by means of an injection molding process, the spout is first closed at its tip and, in order to release the discharge opening at the tip, the tip of the spout is cut off with a knife. A sharp edge that can lead to injury is thus produced at the discharge opening of the spout. This edge has thus far been rounded off, among other things, by the action of heat, during which there is a hazard that the passage in the discharge opening is narrowed too much or even melted together.

SUMMARY OF THE INVENTION

The purpose of the invention is to devise a screw cap with a safety seal device in which there is no possibility of plastic deformation of the locking element when the screw cap with the safety seal applied is screwed on and reliable locking of the screw cap on the container is thus ensured.

Another objective is to devise a screw cap by means of which an injury-threatening edge can be eliminated at the discharge opening of the spout.

The screw cap according to the invention is characterized by the features of a screw cap body (3) and a safety seal device (4, 5) with a continuous band section (4) and a tear-off strip (5) joined to it, said band section (4) containing internal locking elements (6) on its inside each with a leading slope (7) and a locking surface (8), said container (2) having outer locking elements (9) that mesh with the inner locking elements (6) when container (2) is closed and are arranged along the outer periphery of the container at its opening, said band section (4) being joined to the screw cap body (3) via first breakaway webs (10), characterized by the fact that each inner locking element (6) is joined to one of the first breakaway webs (10) via a corresponding first spring element (11). Advantageous variants follow from the dependent claims.

BRIEF DESCRIPTION OF THE DRAWINGS

The object of the invention is further explained below with reference to the drawings. In the drawings.

DETAILED DESCRIPTION OF THE INVENTION

Figure 1:
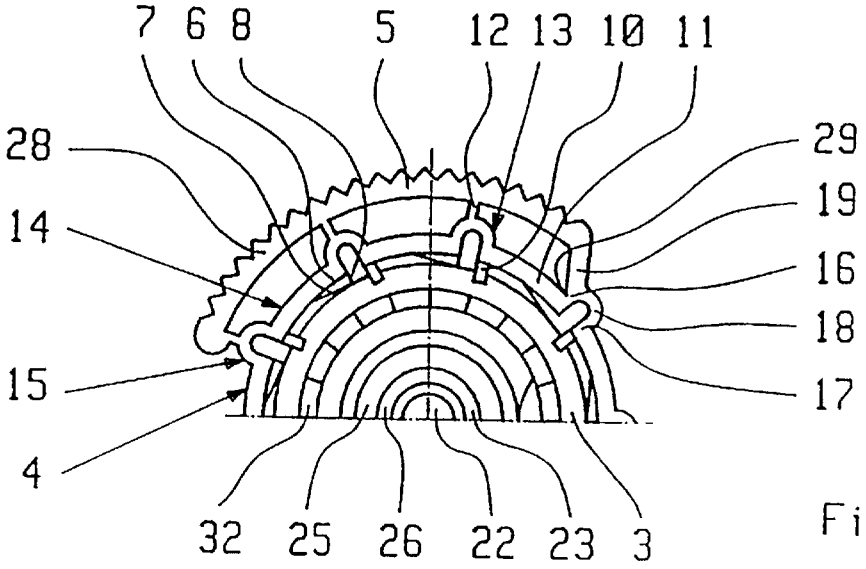
FIG. 1 shows a view from the bottom of the screw cap according to FIG. 2.
Figure 2:
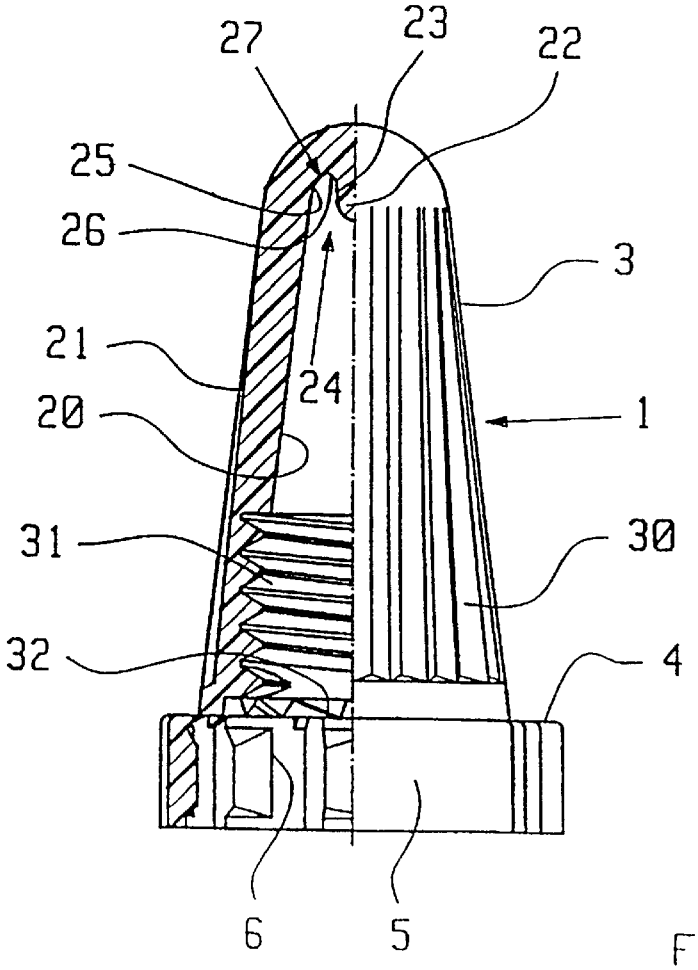
FIG. 2 shows a screw cap partially in section and partially in a side view.

The screw cap 1 depicted in FIGS. 1 and 2 has a screw cap body 3 which is equipped with a safety seal device, which contains as most essential parts a continuous band section 4 and a tear-off strip 5 joined to band section 4. These parts are produced from an appropriate plastic.

Inward protruding, wedge-shaped locking elements 6 are formed along the continuous band section 4. Each locking element 6 has a leading slope 7 and a locking surface 8.

The band section 4 is divided into alternately arranged circular arc sections 14 and U-shaped sections 15, in which the arms of the U shape face the interior of screw cap 1.

In particular, each U-shaped section 15 has a first arm 16 and a second arm 17, said arms 16, 17 being joined to each other via a base section 18.

The continuous band section 4 of the safety seal is joined to the screw cap body 3 via first breakaway webs 10. As is generally known, these first breakaway webs 10 are weaker than the band section 4 so that under the influence of a force these breakaway, webs 10 tear, but not the band section 4. It is apparent from FIG. 1 that the second arm 17 of each U-shaped band section 15 in principle is joined to the screw cap body 3 via such a breakaway web 10.

The tear-off strip 5 runs along the outer side of the band section 4. It is designed structured on one end for facilitated grasping by a toothed section 28. On the opposite end, the tear-off strip 5 is joined to the band section 4 via a rigid transition piece 19, especially to the first arm 16 of the corresponding U-shaped section 15. It is apparent that the rigid transition piece 19 includes an acute angle with the circular arc section 14 so that a tear-off notch 29 is formed.

The tear-off strip 5 is also joined to some of the U-shaped sections 15 via additional breakaway webs 12, said additional breakaway webs 12 being joined to a base section 18 of the U-shaped section 15.

The additional breakaway webs 12 are weaker than the first breakaway webs 10 so that under the influence of force on the tear-off strip 5 and the band section 4 the additional breakaway webs 12 tear before the first breakaway webs 10.

The inner locking elements 6 are arranged not rigidly, but so that they can yield elastically. In particular, a first spring element 11 formed from part of band section 4 extends in particular between each inner locking element 6 and the adjacent first breakaway web 10, viewed in the counter-clockwise direction of FIG. 1. Another spring element 13 is formed by part of the base section 18 of the adjacent U-shaped section 15 between an inner locking element 6 and the additional adjacent breakaway web 12 when viewed in the clockwise direction and also the first breakaway web 10.

It is therefore apparent that the inner locking element 6 can yield outward elastically.

FIG. 2 of the drawings is now referred to. The screw cap body 3 of screw cap 1 has an inner wall 20 and an outer wall 21. For facilitated activation of the screw cap body 3, i.e., rotation, its outer wall 21 is designed furrowed, as indicated with reference number 30. An internal threading 31 is present in the lower part of inner wall 20.

On the upper end of the screw cap body 3, a pin 22 protrudes into the inner space of the screw cap body 3. An annular space 24 is thus formed at the zenith of the screw cap body 3, which is enclosed, on the one hand, by the peripheral wall 23 of pin 22 and, on the other hand, by a section of the inner wall 20. This inner wall 20 has a section 25 on its upper end that is curved toward pin 22. A linear flat section 26 is connected to this curved section 25, in which the sections 25 and 26 form at least roughly a right angle with each other at their transition site 27.

For the sake of completeness teeth 32 are also shown. These teeth 32 serve to accommodate a tool during mold release, by means of which tool a screw cap 1 is rotated in order to be screwed out of the threading of the corresponding casting mold.

Figure 4:
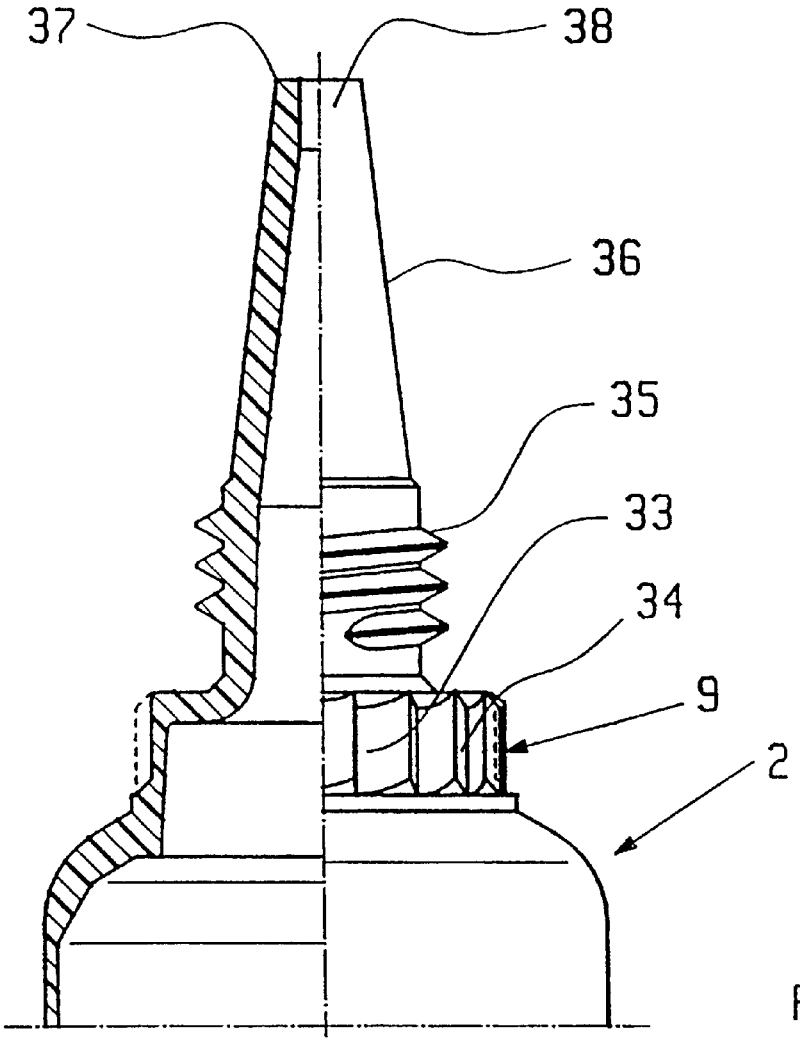
FIG. 4 shows the upper part of the container, partially in section and partially in a side view.
Figure 3:
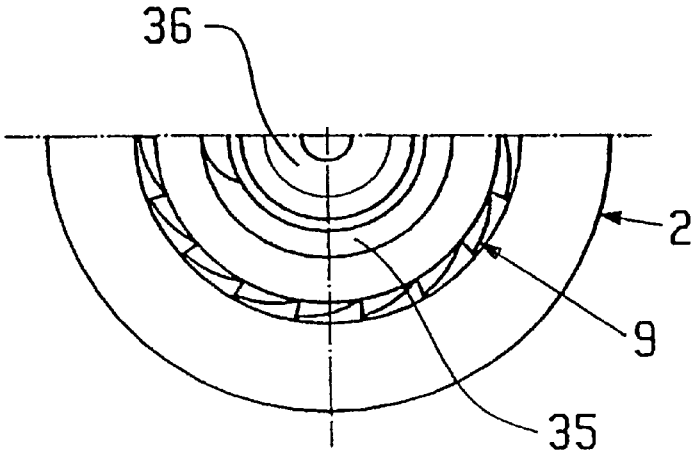
FIG. 3 shows a view from the top of the upper part of the container depicted in FIG. 4

FIGS. 3 and 4 are now referred to in which part of the container 2 is shown. This container 2 is intended, for example, to receive eye drops, is produced from an appropriate plastic and is designed compressible to release the eye drops.

The container neck is enclosed by outer locking elements 9 which are designed as counterparts to the inner locking elements 6 of screw cap 1 and consequently also have a leading slope 33 and a locking surface 34. Outside threading 35 is present above the locking elements 9 which is finally followed by the discharge spout 36.

To close the container 2, the screw cap 1 is placed on the spout 36 and screwed on. Toward the end of the screwing movement, the leading slopes 7 of the locking element 6 of band section 4 begin to run onto the leading slopes 33 of the locking elements 9 of container 2. Because the locking element 6 can now yield elastically because of the spring elements 11 and 13, plastic deformation of both the locking elements 6 and the locking elements 9 is ruled out, in which it must be noted that the locking elements 6 and 9 obviously also exhibit a certain elasticity.

When the screw cap is fully screwed on, it cannot be screwed back because such rotational movement is made impossible by the superimposed locking surfaces 8 and 34 of the continuous band section 4 of the screw cap and of the container 2.

To remove the screw cap 1 from container 2 in order to open it, the tear-off strip 5 is grasped at the toothed section 28 and pulled off. The additional breakaway webs 12 are then torn. Since these are weaker than the first breakaway webs 10, the latter are not initially influenced by the tear-off force. When all the additional breakaway webs 12 (three in the depicted practical example) are torn, the rigid transitional piece 19 begins to pivot outward from continued pulling on the tear-off strip 5, i.e., in the clockwise direction based on FIG. 1. The connection region between the first arm 16 and the band section at that location is now torn off at the tear-off notch 29. By continued tearing of the tear-off strip 5, the first breakaway webs 10 are broken in sequence and ultimately the entire safety seal, i.e., band section 4 and tear-off strip 5 can be removed from screw cap 1 so that this can be screwed off of container 2.

FIGS. 2 and 4 are now referred to again. The spout 36 is shown in FIG. 4 with a sharp edge 37 at the discharge opening 38.

If the screw cap 1 is screwed onto container 2, the pin 22 penetrates into the discharge opening 38. The edge 37 begins to run along the curved section 25 and is deformed inward so that the upper flat region 38 only brings the discharge opening 38 to lie against the linear section 26. The spout 36 is thus plastically deformed at the discharge opening 38 so that no free edge is present that could contribute to injury.

What is claimed is:

1. Screw cap for closure of a container, said screw cap having a screw cap body and a safety seal device with a continuous band section and a tear-off strip joined to it, said band section containing inner locking elements on its inside each with a leading slope and a locking surface said container having outer locking elements that mesh with the inner locking elements when container is closed and are arranged along the outer periphery at its opening, said band section being joined to the screw cap body via first breakaway webs, said inner locking elements being joined via first spring elements to the first breakaway webs, characterized by the fact that the tear-off strip is joined via additional breakaway webs to the continuous band section and that the inner locking elements arranged in the region of the tear-off strip are joined via additional spring elements to the additional breakaway webs, in which the rupture strength of the first breakaway webs is higher than the rupture strength of the additional breakaway webs further characterized by the fact that the continuous band section has circular arc-shaped and U-shaped sections arranged in alternation, in which each U-shaped section has a first and a second arm, said arms being joined to each other via a base section, and that each first arm is designed in one piece with one of the inner locking elements, each second arm is designed in one piece with one of the first breakaway webs and each base section is designed in one piece with one of the additional breakaway webs.

2. Screw cap according to claim 1, characterized by the fact that the tear-off strip is joined on one end via a rigid transition piece to the first arm of one of the U-shaped sections and forms an acute angle with the circular arc-shaped band section adjacent to the U-shaped section to form a tear-off notch.

* * * * *